US006179517B1

(12) United States Patent
Nelson

(10) Patent No.: US 6,179,517 B1
(45) Date of Patent: Jan. 30, 2001

(54) TRAFFIC ACCESS CONTROL SYSTEM

(76) Inventor: Kim L. Nelson, 3548 Southwood Ct., Davie, FL (US) 33328

( * ) Notice: Under 35 U.S.C. 154(b), the term of this patent shall be extended for 0 days.

(21) Appl. No.: 09/405,645

(22) Filed: Sep. 24, 1999

Related U.S. Application Data

(60) Provisional application No. 60/144,997, filed on Jul. 22, 1999.

(51) Int. Cl.[7] ..... E01F 13/00; E01F 15/00; E01F 13/04; E01F 13/06; E01F 15/12

(52) U.S. Cl. ..... 404/6; 49/26; 49/28; 49/49

(58) Field of Search ..... 404/6, 9; 49/49, 49/28

(56) References Cited

U.S. PATENT DOCUMENTS

| | | | | |
|---|---|---|---|---|
| 3,964,704 | * | 6/1976 | Karr | 49/138 |
| 3,975,861 | * | 8/1976 | Baump et al. | 49/28 |
| 4,035,955 | * | 7/1977 | Burnett | 49/280 |
| 4,232,484 | | 11/1980 | Buchman | 49/334 |
| 4,313,281 | * | 2/1982 | Richmond | 49/280 |
| 4,364,200 | | 12/1982 | Cobb | 49/192 |
| 4,392,392 | * | 7/1983 | Perisic et al. | 74/626 |
| 4,403,449 | * | 9/1983 | Richmond | 49/340 |
| 4,434,578 | | 3/1984 | Rumpz | 49/49 |
| 4,531,325 | * | 7/1985 | Phillips | 49/49 |
| 4,632,598 | * | 12/1986 | Richards | 404/6 |
| 4,665,650 | * | 5/1987 | Hall | 49/344 |
| 4,711,608 | | 12/1987 | Ghusn | 404/6 |
| 4,916,859 | * | 4/1990 | Butler | 49/9 |
| 4,916,860 | * | 4/1990 | Richmond et al. | 49/28 |
| 4,934,097 | * | 6/1990 | Quante | 49/49 |
| 5,076,012 | * | 12/1991 | Richmond et al. | 49/28 |
| 5,101,595 | * | 4/1992 | Rhoades | 49/28 |
| 5,123,204 | * | 6/1992 | He | 49/334 |
| 5,136,809 | * | 8/1992 | Richmond et al. | 49/28 |
| 5,136,810 | * | 8/1992 | DeWitt, III | 49/49 |
| 5,230,179 | * | 7/1993 | Richmond et al. | 49/28 |
| 5,263,281 | | 11/1993 | Osborn | 49/280 |
| 5,415,055 | | 5/1995 | Henfrey | 74/96 |
| 5,438,799 | * | 8/1995 | Le Faucheur | 49/49 |
| 5,671,563 | * | 9/1997 | Marcum | 49/49 |
| 5,813,796 | | 9/1998 | Kocznar | 404/6 |
| 5,869,940 | * | 2/1999 | Parsadayan | 318/461 |
| 5,878,530 | * | 3/1999 | Eccleston et al. | 49/139 |
| 5,884,432 | | 3/1999 | Delillo | 49/49 |
| 6,025,685 | * | 2/2000 | Parsadayan | 49/28 |

* cited by examiner

*Primary Examiner*—Eileen D. Lillis
*Assistant Examiner*—Alexandra Pechhold
(74) *Attorney, Agent, or Firm*—Alvin S. Blum

(57) ABSTRACT

Apparatus for controlling the flow of traffic through one or more traffic lanes includes a member that attaches to a traffic barrier such as a bar, a gate, or door. Under the control of an actuating element such as a control card, code entry, or manual switch, the member is rotated by an electric motor that drives a reduction gear connected through an adjustable slip clutch to a drive shaft connected to the member. The motor provides variable speed of rotation to the member so that the member will move more slowly at the beginning and end of its movement between open and closed positions of the barrier for safety of operation. The motor function is controlled by a microprocessor or microcontroller. The motor speed control may be by use of a DC motor powered by a current of DC pulses with variable pulse width. Alternatively, motor speed control may be by use of an AC motor with variable AC frequency power.

15 Claims, 5 Drawing Sheets

TRAFFIC ACCESS CONTROL SYSTEM

This application is based upon Provisional Patent Application Ser. No. 60/144,997 filed Jul. 22, 1999, incorporated herein by reference.

BACKGROUND OF THE INVENTION

This invention relates to access control systems and more particularly to electrically controlled systems for opening and closing one or more obstructions to traverse of a vehicle or an individual through a passage.

DESCRIPTION OF THE PRIOR ART

It is well known to apply barriers of one sort or another to passage of a vehicle. These barriers may require payment of a fee for temporary removal such as on a toll road. They may require entry of a secret or identifier code, application of a code card, display of a pass, or the like, such as in gated communities. There may be a complete secondary barrier, such as a door, and a primary gate, such as a bar that rotates about a horizontal axis through an angle of 90 degrees. It is useful to delay opening the secondary gate until the barrier is fully open. Gates of the prior art are often subject to damage when the gate is forced open. Their use may be lost while repairs are awaited. These are not the sort of items whose loss of use, even temporarily, is tolerated. Some provision should also be provided for opening the gate in case of power failure. These gates require a non-uniform motion for best operation. They often use a non-circular rotary actuator for this purpose, but this results in undesirable variable forces on the gear system as well as more costly structure. It also wears the gears irregularly because only a fraction of the gear teeth are ever used. In the case of a fire, and/or power loss it is especially important that the access barrier remain open or be openable or by fire fighters from outside, or by people trapped inside, even with loss of power.

SUMMARY OF THE INVENTION

It is accordingly an object of the invention to provide a traffic access control system that overcomes some of the deficiencies of the prior art. The system of the invention may be applied to a variety of access barriers, including, but not limited to, vertically or horizontally swinging bars and gates, vertically and horizontally rolling doors and grilles and the like. It may be applied to traffic by vehicles or individuals. It is another object that the control system of the invention anticipate many of the maintenance problems of the prior art, and provide means for rapid and simple repair that reduce the time that the apparatus is out of operation and the cost of many repairs. The system of the invention includes a high ratio gearmotor whose output may turn an output gear through only about 90°, when moving a barrier between open and closed positions. The gear drives an output shaft through a slip clutch. The output shaft is directly attached to a barrier connecting member that holds the barrier bar and to shaft position sensors. When the motor drives the output gear in normal operation between open and closed positions, the system automatically senses whether the bar is up or down. If the bar is down, and someone lifts the bar to gain access, the shaft will rotate with the bar and the system will sense the bar position. An optional output trigger may be generated to notify the system of such an event. However, the clutch will slip so that there will be no turning of the output gear, and no damage to the apparatus. Once a close signal is received, the barrier automatically realigns the barrier to the horizontal position. Another advantage is that a different quadrant of the gear is now in use. For routine maintenance, one need only lift the bar periodically to ensure uniform wear of the gear. It is necessary to provide some means of allowing access in case of power failure. The system provides a backup battery on continuous charge. The system senses when power fails. It provides a signal to open the gate if the power has been off for more than a preset time. It may include means requiring a trigger before the backup opens the gate. The system may also be provided with battery charge sensing means and means to elevate the gate when power fails and the battery charge falls below a pre-selected value.

The motor drive is a reversing DC gearmotor. It is driven by a series of DC pulses of variable width so that the output rotary motion can be non-uniform. This results in the same motion as provided by non-circular drive components such as the sinusoidal drives well known in this art, but with numerous cost and function advantages enjoyed by uniform circular components.

Alternatively, the motor drive may be an AC motor with variable frequency power to achieve non-uniform motion.

A principal application of the invention will be to operate vehicular barriers that pivot through about 90° about a horizontal axis from a horizontal closed position to vertical open position. Other applications operate barriers such as doors that slide, raise, or pivot about a vertical axis.

These and other objects, features and advantages of the invention will become more apparent when the detailed description is studied in conjunction with the drawings, in which like reference characters indicate like elements in the various drawing figures.

DETAILED DESCRIPTION OF PREFERRED EMBODIMENTS

Figure 1:
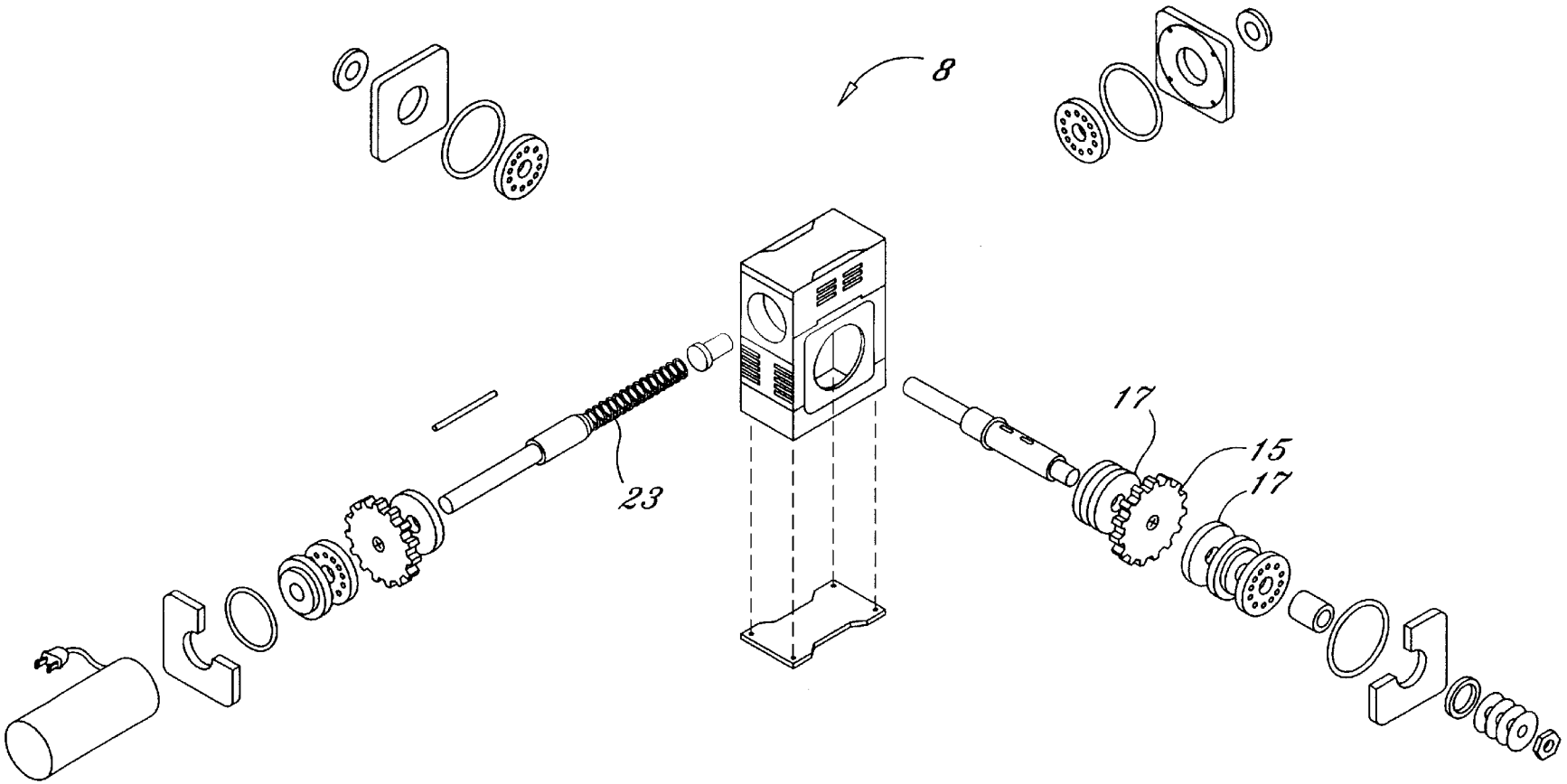
FIG. 1 is an exploded view of a reduction gear with clutch of the invention.
Figure 2:
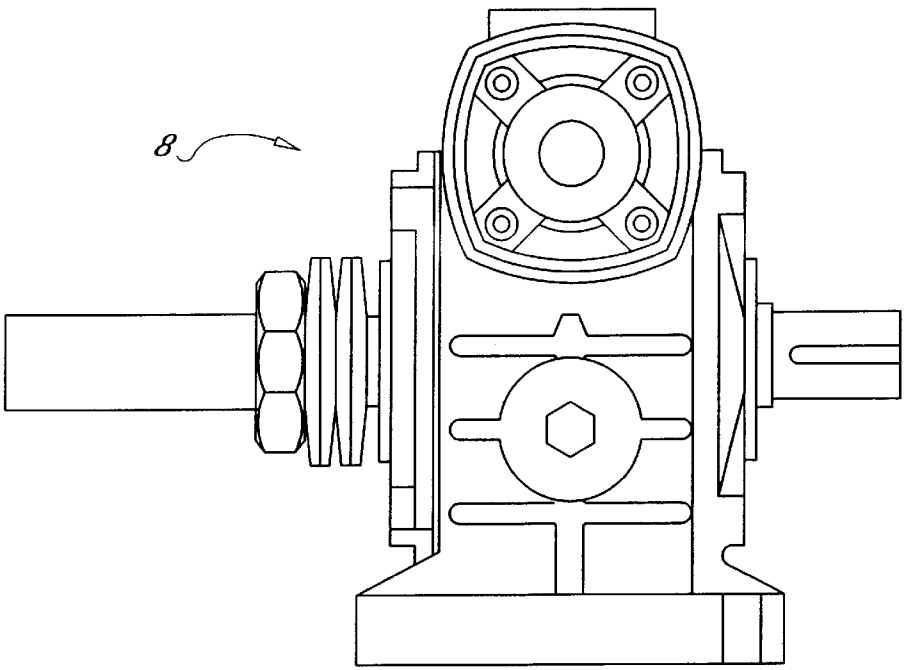
FIG. 2 is a rear elevation view of the device of FIG. 1.
Figure 3:
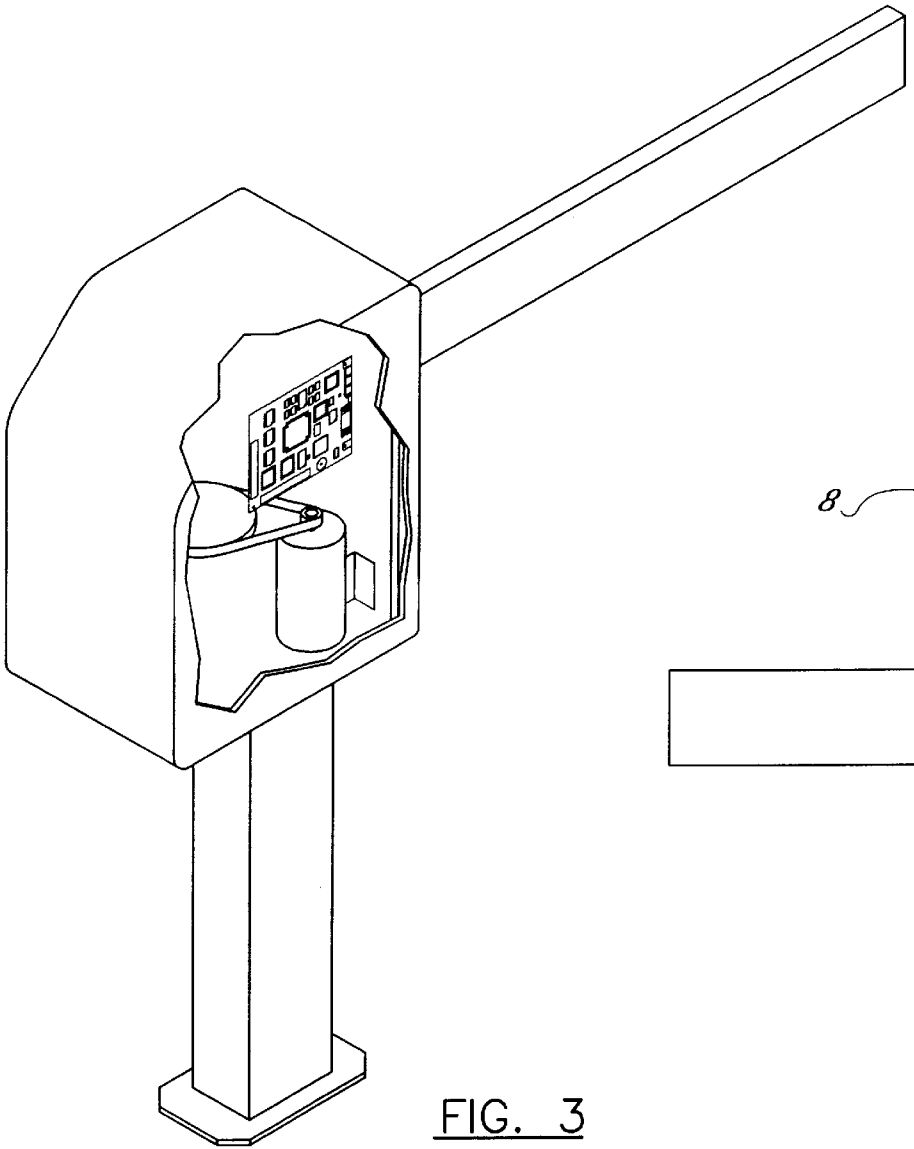
FIG. 3 is a perspective view, partially exploded and broken away, of a gate control system of the invention.
Figure 4:
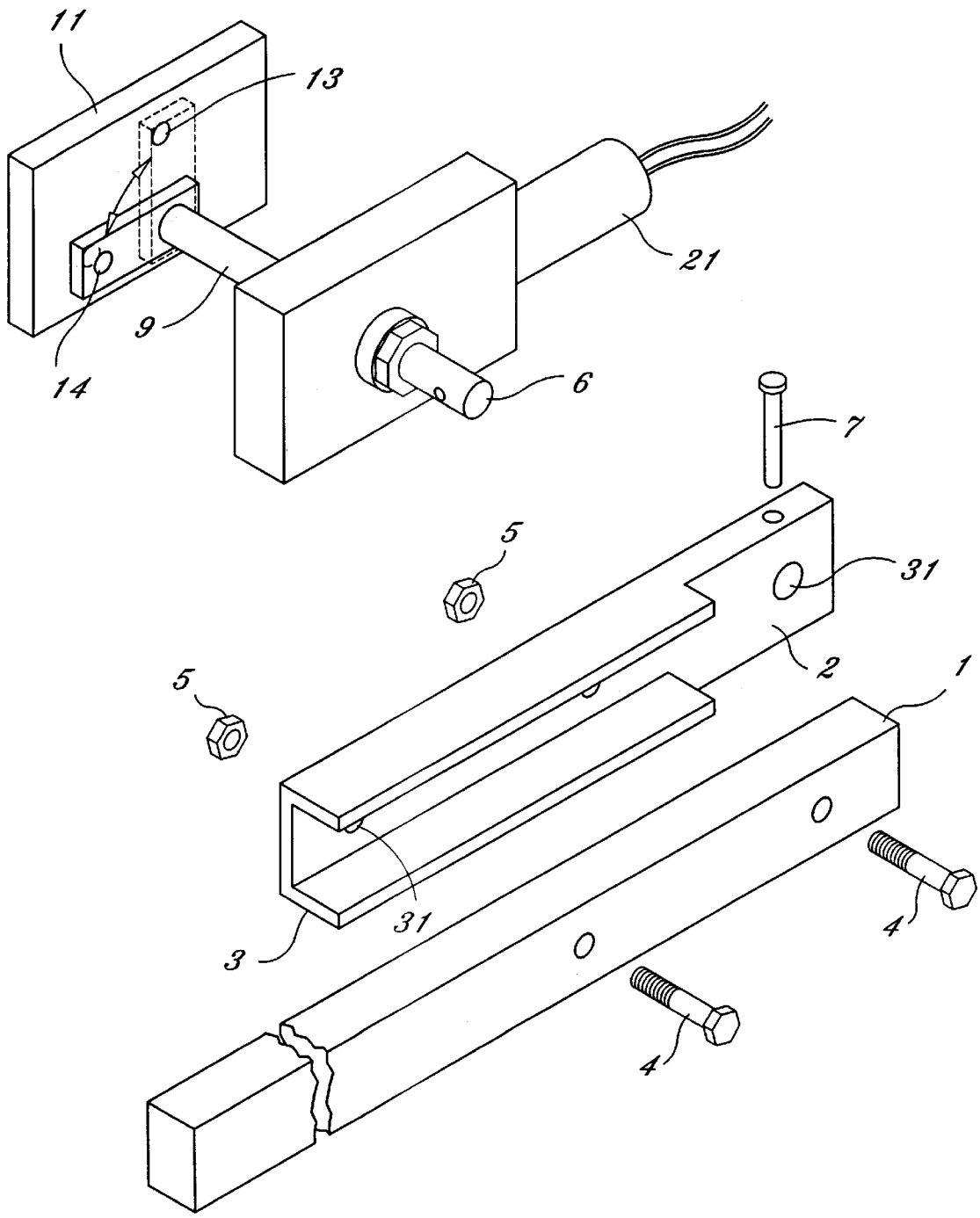
FIG. 4 is a diagrammatic, partially exploded, perspective view of an access control system of the invention.
Figure 5:
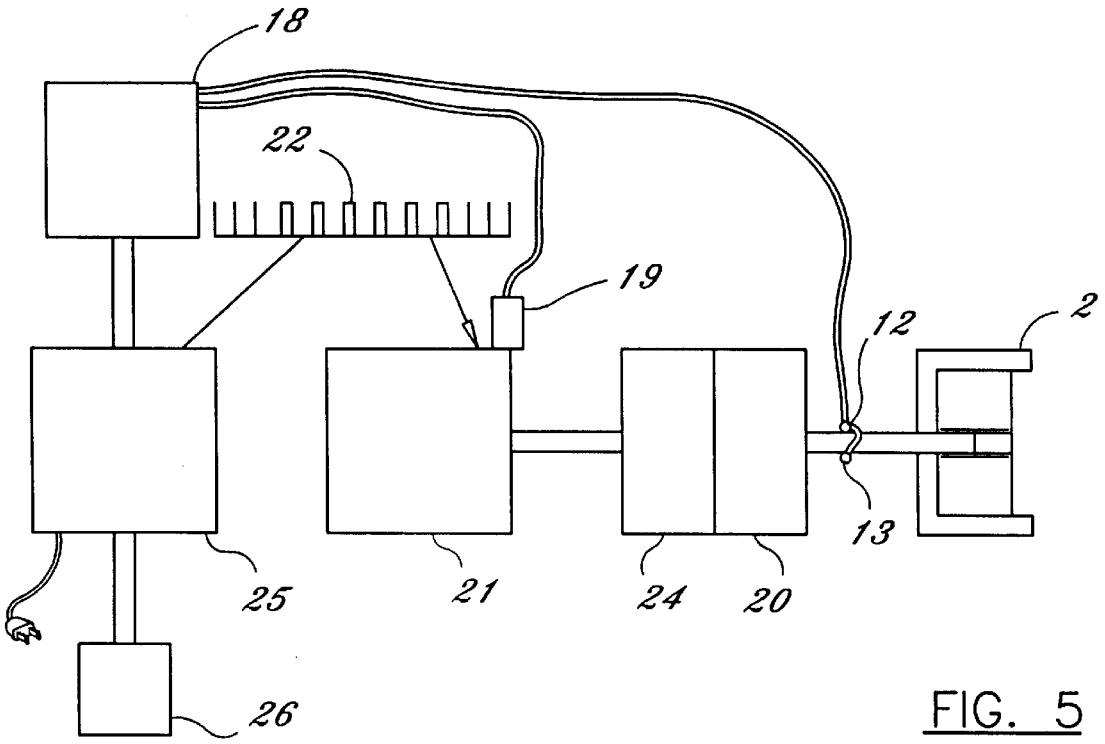
FIG. 5 is a schematic diagrammatic representation of the invention with pulse width DC speed control.

Referring now to the drawing FIGS. 1–5, an exemplary access control system of the invention is shown in the form of a rotary bar that swings about a horizontal axis through an angle of 90 degrees between a horizontal closed position and a vertical open position. The actuation of the mechanism may be initiated by a manual switch in a gatehouse, a card reader, a keypad, or another device well known in the art. The reversible motor is powered by a low voltage direct current from an AC line through a DC power supply 25. A solar panel or trickle charger (not shown) keeps a standby battery 26 fully charged. When a sensor detects a failure of power, the battery power automatically cuts in. The system may be programmed to automatically open the barrier at that time, or when a trigger signal is applied. As best seen in FIG. 4, the bar 1 is held securely in a three sided member 2 such that the member takes the weight of the bar distributed over its lower flange 3. Bolts 4 through apertures 31 in the web of member 2 hold the bar to member 2 with frangible plastic nuts 5. When a vehicle strikes the bar, the nuts will yield before any other damage is done. A supply of inexpensive nuts is kept on hand. The damage is then readily repaired with negligible time or labor cost. The member 2 is secured to rotary drive shaft 6 by shear pin 7 that will not yield before nuts 5. Shaft 6 passes through housing or gearcase 8 and out the other side to end 9, which is fixed to magnet carrier 10. Circuit board 11 carries all of the control circuitry including: a microprocessor or microcontroller 18; semiconductor switch means 19 to drive the motor in forward or reverse; and two Hall effect sensors 12, 13 to cooperate with magnet 14 on carrier 10 to detect the up and down positions respectively of the bar 1. Optionally other position sensors such as mechanical switches may be used. A reduction gear assembly 24 includes worm 23 that drives the output worm gear 15 (FIG. 1) that is rotatably mounted on shaft 6. The friction-clutch or slip clutch assembly 20 causes the gear to move with the shaft until a certain resistance to shaft motion is encountered. The slip point is adjusted by nut 16, which forces the friction discs 17 against the sides of the gear 15. In normal operation, only one quarter of the gear is in use. When the bar is forced up while the motor is stopped, the shaft will rotate, but the gear will not. An optional output pulse may be sent to the system to notify it of the occurrence of that event. The system will then automatically level the arm at the horizontal position after receiving a close signal. The position sensor mechanism will remain functional, and no damage is done. Furthermore, a new quadrant of the gear is now in use. This mechanism may be used to ensure uniform wear of the gear. The semiconductor switch mechanism 19 that drives the motor 21 applies power in the form of a series of DC pulses 22. It drives the motor in either forward or reverse direction as required to permit or deny access. It is desirable to move the barrier more slowly at the beginning and end of the travel for safety. The mechanism for achieving this is provided by pulse width modulation. That is, the pulses are narrower at the beginning and end of travel, which results in slower motion at these times. Since this is under control of microprocessor 18, any particular motion can be achieved by simply changing the program. This has many advantages over a hardware mechanism. When the system includes a movable first gate and a more complete second barrier such as a door, a signal to open the first gate will be stored while the system interrogates the second barrier until it senses that it is open before it will open the first gate. The system may lock out opening of the more complete second barrier when the first barrier is forced open to prevent tampering with the access control.

Figure 7:
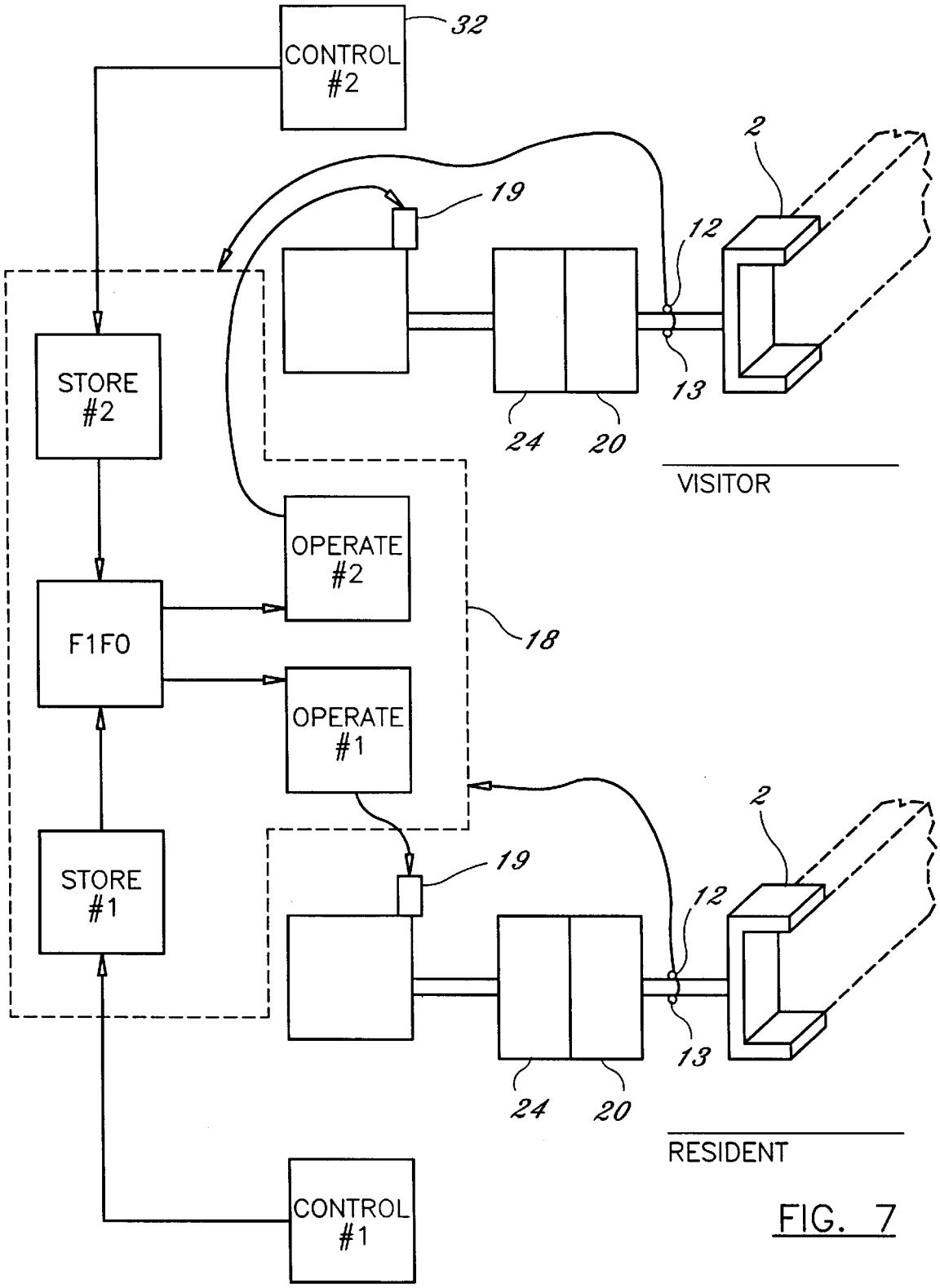
FIG. 7 is a schematic diagrammatic representation of another embodiment in which a control system operates two separate traffic lane barriers.

This mechanism of monitoring two access control devices may also be used to regulate two gates in adjacent lanes, such as a resident lane and a visitor lane as illustrated schematically in FIG. 7. Each may lock out the other while the first is operating, but the order to open the second one will be stored by the system in memories 34 and begin opening the second gate when the first gate has finished operation by action of the first-in-first-out (FIFO) program well known in the art of microprocessor 18.

The microcontroller or electronic control means 18 may be programmed to perform other useful functions, such as shutting off the motor after a preset time of operation so as to prevent the continuing running when the barrier encounters an obstacle before completion of the motion. In gated communities there are frequent complaints when a following vehicle tries to pass before the gate comes down. The system may be programmed to open the barrier when it encounters an obstacle during closing to overcome this problem.

Figure 6:
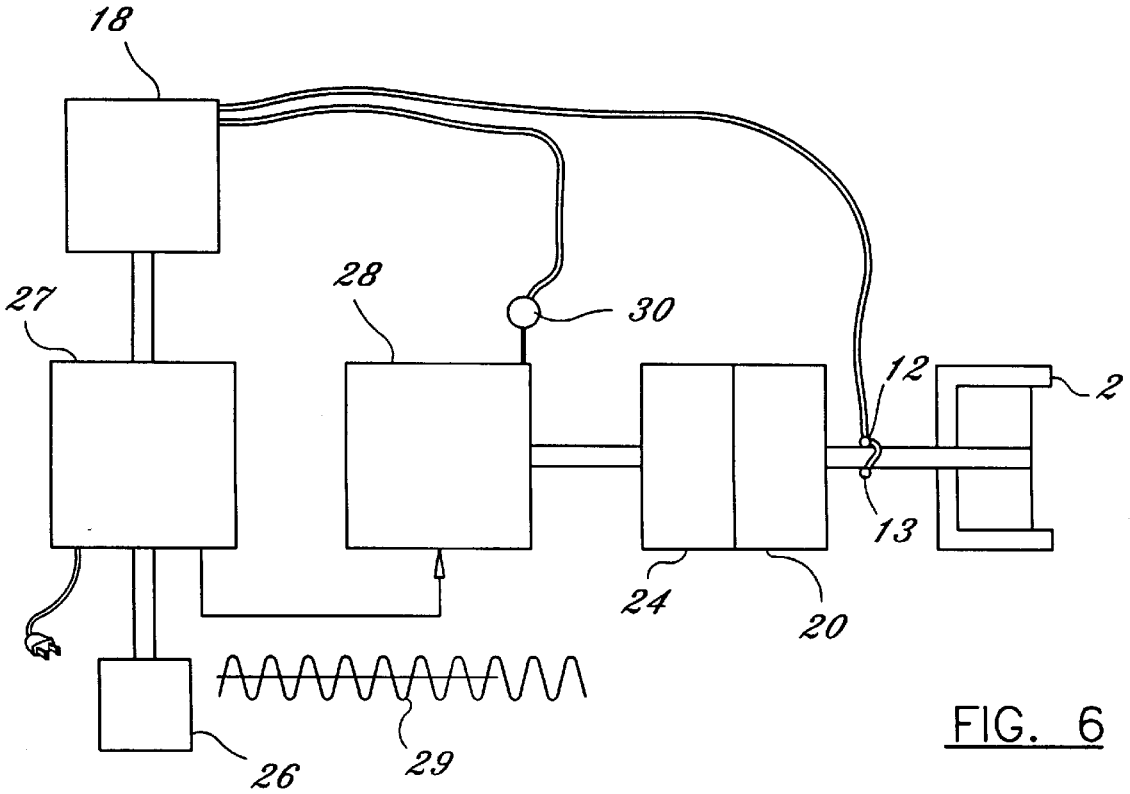
FIG. 6 is a schematic diagrammatic representation of another embodiment of the invention using variable frequency AC speed control.

Referring now to FIG. 6, non-uniform motion of the output shaft may be alternatively achieved by use of an AC motor 28 powered by an alternating current power supply 27 whose frequency is controlled by the microcontroller 18, generating an alternating current of variable frequency 29. The motor is reversed by reversing switch 30.

The above disclosed invention has a number of particular features which should preferably be employed in combination, although each is useful separately without departure from the scope of the invention.

While I have shown and described the preferred embodiments of my invention, it will be understood that the invention may be embodied otherwise than herein specifically illustrated or described, and that certain changes in form and arrangement of parts and the specific manner of practicing the invention may be made within the underlying idea or principles of the invention.

What is claimed is:

1. A traffic barrier control apparatus for controlling the flow of traffic through at least one traffic lane under the control of at least one actuating element, the apparatus comprising:

a) a barrier connecting member for connecting thereto a traffic barrier;

b) a housing;

c) a drive shaft rotatably mounted in the housing and attached to the barrier connecting member for rotating the barrier connecting member between open and closed conditions;

d) a reversible electric motor connected to a reduction gear mechanism, the motor provided with an electric power supply;

e) an adjustable slip clutch mechanism connecting the reduction gear mechanism to the drive shaft such that manual movement of the barrier will rotate the drive shaft but not the reduction gear mechanism;

f) position sensor means coupled to the drive shaft for sensing the open and closed conditions of the drive shaft and the barrier attached thereto;

g) an electronic control means for controlling the electric power supply, the control means connected to the position sensor means, and the electric power supply; and h) the electronic control means cooperating with the electric power supply to control the motor speed to change the rotational speed of the drive shaft at different positions of the barrier connecting member and to actuate the apparatus when called upon by an actuating element to rotate the barrier connecting member between open and closed conditions.

2. The apparatus according to claim 1, in which the motor is a direct current motor and the electric power supply provides direct current pulses of varying widths to control the motor speed.

3. The apparatus according to claim 2, in which the barrier connecting member is provided with frangible fasteners for attachment thereto of a barrier.

4. The apparatus according to claim 2 further providing battery backup means for continued operation in the event of municipal power failure.

5. The apparatus according to claim 1, in which the motor is an alternating current motor and the power supply provides alternating current of varying frequencies to control motor speed.

6. The apparatus according to claim 5, in which the barrier connecting member is provided with frangible fasteners for attachment thereto of a barrier.

7. The apparatus according to claim 1, in which the electronic control means is operatively connected to a plurality of motors, barrier connecting members, housings, drive shafts, and slip clutch mechanisms for operating a plurality of barriers in a plurality of traffic lanes while coordinating operations therebetween.

8. The apparatus according to claim 7 further providing battery backup means for continued operation in the event of municipal power failure.

9. The apparatus according to claim 1 further providing battery backup means for continued operation in the event of municipal power failure.

10. The apparatus according to claim 1, in which the barrier connecting member is a U shaped channel with flanges and a web with the flanges disposed horizontally and apertures in the web, and the apparatus further comprises bolts with frangible nuts for insertion in the apertures to releasably secure a barrier thereto.

11. A traffic barrier control apparatus for controlling the flow of traffic through at least one traffic lane under the control of at least one actuating element, the apparatus comprising:

a) a barrier connecting member for connecting thereto a traffic barrier;

b) a housing;

c) a drive shaft rotatably mounted in the housing and attached to the barrier connecting member for rotating the barrier connecting member between open and closed conditions;

d) a reversible electric motor coupled to a worm, the motor provided with an electric power supply;

e) a worm gear rotatably mounted on the drive shaft and constructed for cooperation with the worm;

f) a slip clutch means mounted on the drive shaft for releasably coupling the worm gear to the drive shaft at preset torque levels such that manual movement of the barrier will rotate the drive shaft without rotating the worm gear;

g) position sensor means coupled to the drive shaft for sensing the open and closed conditions of the drive shaft and the barrier attached thereto;

h) an electronic control means for controlling the electric power supply, the control means connected to the position sensor means, and the electric power supply; and i) the electronic control means cooperating with the electric power supply and the position sensor means to control the motor speed to change the rotational speed of the drive shaft at different positions of the barrier connecting member and to actuate the apparatus when called upon by an actuating element to rotate the barrier connecting member between open and closed conditions.

12. The apparatus according to claim 11, further comprising:

a plurality of barriers for controlling flow of traffic through a plurality of traffic lanes;

at least one actuating element associated with each lane for ordering opening of a barrier to traffic flow through that lane; and the electronic control means provided with means for storing an order for opening a second barrier while a first barrier is open, and then executing the stored order for opening the second barrier after the first barrier closes.

13. The apparatus according to claim 11, further comprising means for holding the barrier open or opening the barrier when a fire signal is received.

14. The apparatus according to claim 11, further comprising:

a standby power supply battery;

charge sensing means for sensing the charge on the battery; and means for opening the barrier when the power has failed and the charge on the battery falls below a preset value as indicated by the charge sensing means.

15. A traffic barrier control apparatus for controlling the flow of traffic through at least one traffic lane under the control of at least one actuating element, the apparatus comprising:

a) a barrier connecting member for connecting thereto a traffic barrier;

b) a housing;

c) a drive shaft rotatably mounted in the housing and attached to the barrier connecting member for rotating the barrier connecting member between open and closed conditions;

d) a reversible electric motor coupled to a worm, the motor provided with an electric power supply;

e) a worm gear rotatably mounted on the drive shaft and constructed for cooperation with the worm;

f) a slip clutch means mounted on the drive shaft for releasably coupling the worm gear to the drive shaft at preset torque levels such that manual movement of the barrier will rotate the drive shaft without rotating the worm gear;

g) position sensor means coupled to the drive shaft for sensing the open and closed conditions;

h) an electronic control means for controlling the electric power supply, the control means connected to the position sensor means, and the electric power supply; and i) the electronic control means cooperating with the electric power supply and the position sensor means to control the motor to actuate the apparatus when called upon by an actuating element to rotate the barrier connecting member between open and closed conditions.

* * * * *